United States Patent [19]

Kalb

[11] 4,420,678

[45] Dec. 13, 1983

[54] LUNCH BUCKET

[76] Inventor: Frank H. Kalb, 13901 W. Marquette Dr., New Berlin, Wis. 53151

[21] Appl. No.: 250,136

[22] Filed: Apr. 3, 1981

[51] Int. Cl.[3] ..... A21B 1/52; F27D 11/00

[52] U.S. Cl. ..... 219/387; 219/521; 219/524; 312/236

[58] Field of Search ..... 219/385, 386, 387, 432, 219/438, 439, 521, 524, 525; 312/DIG. 33, 236; 206/373, 803; 126/265, 58, 266, 59; 165/48; 99/416

[56] References Cited

U.S. PATENT DOCUMENTS

| | | | |
|---|---|---|---|
| 2,357,555 | 9/1944 | Scaton | 312/DIG. 33 X |
| 2,513,218 | 6/1950 | Turnipseed | 126/266 X |
| 2,577,870 | 12/1951 | Aston | 219/387 |
| 2,598,995 | 6/1952 | Graff | 126/266 X |
| 2,704,319 | 3/1955 | Lott | 219/387 |
| 3,010,006 | 11/1961 | Schwaneke | 219/438 X |
| 3,129,317 | 4/1964 | Howard | 219/387 |
| 3,663,081 | 5/1972 | Williams | 312/236 |
| 4,027,727 | 7/1977 | Pullens | 165/48 |
| 4,037,081 | 7/1977 | Aldridge et al. | 219/387 |
| 4,303,158 | 12/1981 | Perkins | 206/373 |

*Primary Examiner*—Volodymyr Y. Mayewsky
*Attorney, Agent, or Firm*—Andrus, Sceales, Starke & Sawall

[57] ABSTRACT

A lunch bucket or box includes an elongated three-sided container having an L-shaped top cover and a side wall door pivotally attached to the container walls to form a closed container. The container is compartmented with a series of food compartments exposed through the sidewall door, and at least one of which has a vertical divider to define beverage can compartments. The upper end of the container is constructed to releasably receive an integrated hot plate and bowl unit for heating of food products. The container is exposed by opening the top cover.

7 Claims, 6 Drawing Figures

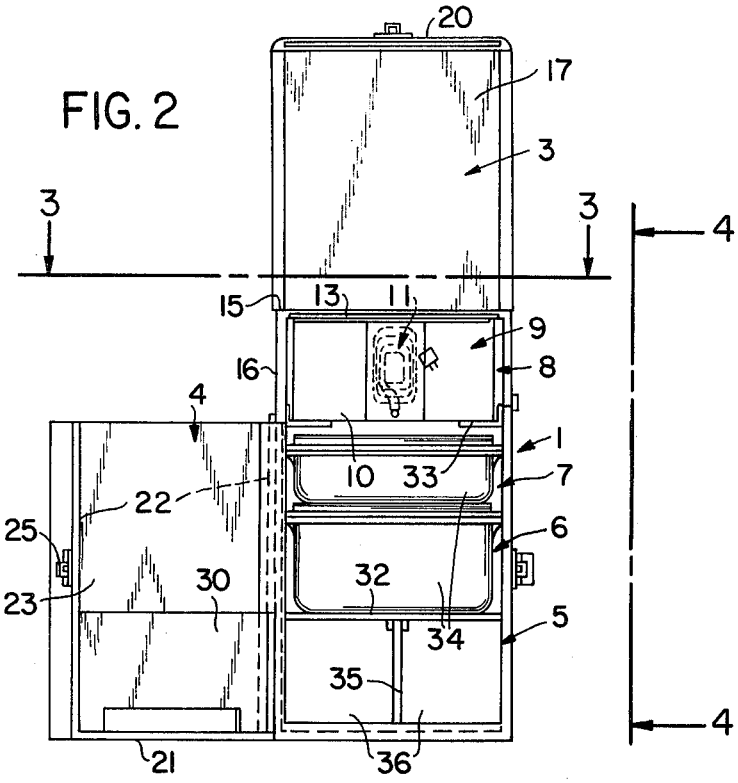
FIG. 2
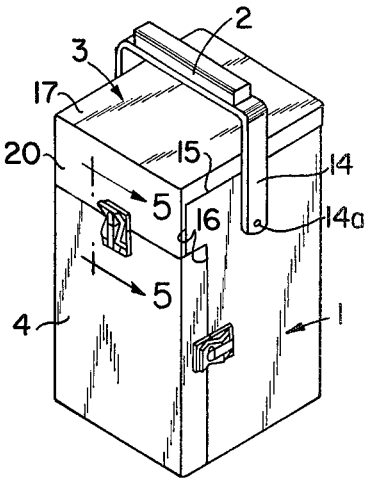
FIG. 1
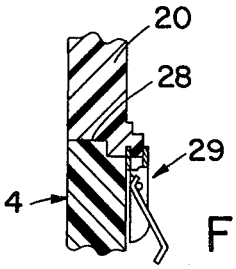
FIG.5
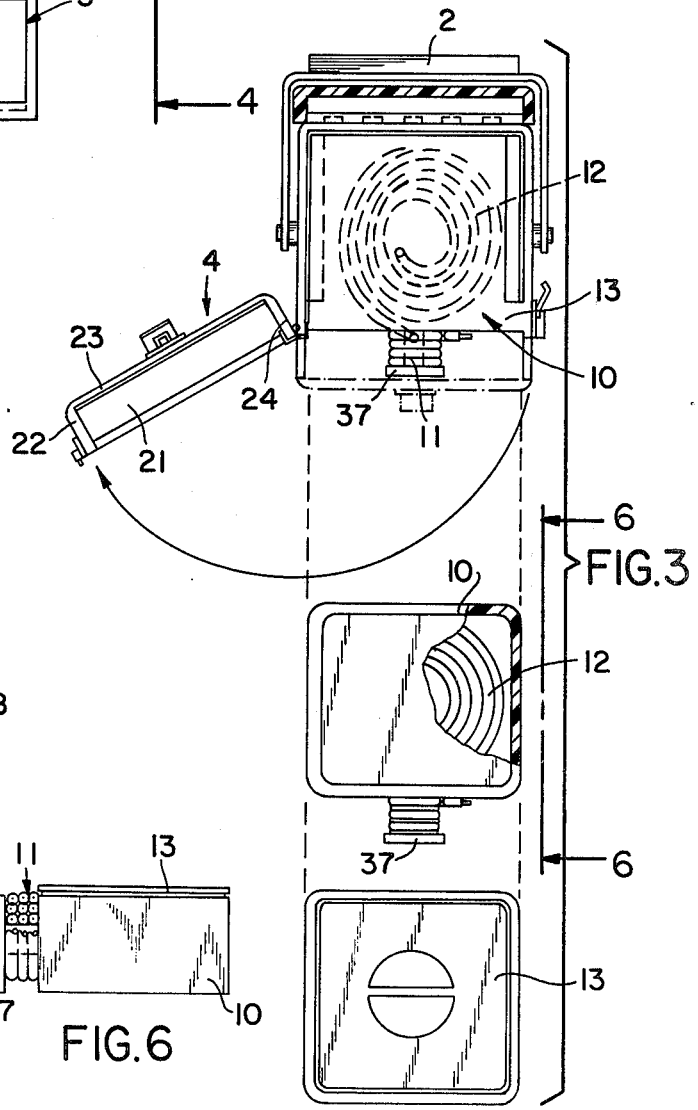
FIG.3
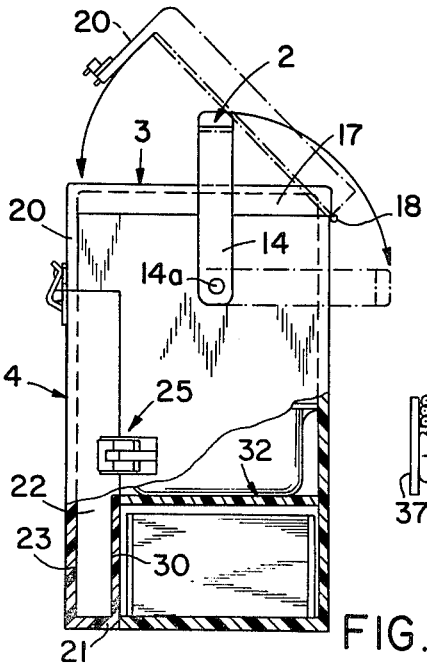
FIG.4
FIG.6

LUNCH BUCKET

BACKGROUND OF THE INVENTION

Lunch buckets or boxes are widely employed to carry various foods for on-job eating. Generally, the lunch box is a relatively small enclosure which is of sufficient volume to carry food for one meal, including sandwiches, liquids and the like. Various insulated members and receptacles have been suggested to permit the carrying of hot and/or cold foods. It has also been suggested that the enclosure be provided with a heating means suitable for heating all or a portion of the food and thereby eliminating the necessity of consuming cold food. For example, U.S. Pat. No. 2,545,127 discloses a heater located in the base portion thereof. U.S. Pat. No. 2,598,995 discloses an insulated lunch box which is generally formed as a double-walled element to provide an insulated carrier. Food is supported within the carrier on a tray structure which is releasably located within the carrier. They also suggest insertion of a heat retaining member under one or more of the food plates to keep the food warm for periods of time. Some prior art, such as U.S. Pat. No. 2,572,826, has suggested liquid fuel burning devices within a separate bottom chamber.

These and similar lunch boxes have been suggested. However, they have not, generally, provided practical implementation and, to the inventor's knowledge, are not available commercially.

Although the user may often desire to heat some food, there are various times when only cold food is desired and the heating unit and associated compartmented portion is not necessary. Further, existing lunch boxes do not provide convenient transport of various food products including canned beverages and the like.

The present invention is particularly directed to an improved novel lunch box having a multiple compartmented housing and a separable integrated on-site heating unit for heating of food product.

SUMMARY OF THE INVENTION

Generally, in accordance with the present invention, a lunch box includes a multiple sectioned container or housing formed of metal, plastic or the like which is formed as a vertically elongated housing. The container or housing is formed with an L-shaped pivoted top cover having a depending sidewall and a partial sidewall cover with conjointly with the depending sidewall of the top cover which serves to close the housing.

A plurality of shelf-members define a plurality of compartments including an uppermost compartment accessible through said open top and through said open side with the length of the depending sidewall of the top cover. A T-shaped bottom divider shelf unit is preferably provided to define a pair of side-by-side compartments adapted to store cans and bottles. A heating unit is releasably deposed within the uppermost compartment. The heating unit preferably includes a bowl having a removable top cover and an electrical cord adapted to be stored on a handle within the open side and open top of the container.

In a normal operation, the user can plug in the heating unit to heat the food within the bowl. If hot food will not be provided, the integrated unit can be removed and the top section used to support another suitable food container.

In accordance with a preferred and unique construction of the present invention, the container is formed as an elongated, square or round container. The container may be formed as a smooth molded member having an exposed top and side wall. The top cover is hinged to the side opposite the exposed sidewall and includes an outer depending sidewall which projects over the sidewall to close the upper portion of the container. The heating unit is supported on a shelf member located at the connecting edges of the top cover and the front door. The front door is shaped as a channel-shaped member to define a shallow compartment within the door.

The present invention provides an efficient and practical lunch box which permits on-site heating of the food, when desired.

BRIEF DESCRIPTION OF THE DRAWING

The drawing furnished herewith illustrates a preferred construction of the present invention in which the above advantages and features are clearly disclosed as well as others which will be readily understood from the following description.

In the drawing:

FIG. 1 is a pictorial view of a lunch box constructed in accordance with this invention;

FIG. 2 is an enlarged frontal view with a top cover and a sidewall cover of the lunch box shown in the open position;

FIG. 3 is a plan view taken generally on line 3—3 of FIG. 2 with an integrated heating removed from the lunch box and shown in exploded view;

FIG. 4 is a side view taken generally on line 4—4 of FIG. 2;

FIG. 5 is an enlarged vertical section taken generally on line 5—5 of FIG. 1; and FIG. 6 is a side elevational view taken generally on line 6—6 of FIG. 3.

DESCRIPTION OF THE ILLUSTRATED EMBODIMENT

Referring to the drawings, and particularly to FIG. 1, the illustrated lunch box constructed in accordance with the teaching of the invention and is generally a tubular multiple section lunch box, having an elongated housing with a top pivoted handle 2 interconnected to the upper end. The lunch box includes a top door or cover 3 pivotally secured to the top and a sidewall or front door 4 pivotally secured to the side of the container 1 for access thereto.

The housing 1 is divided into a multiple level compartments 5, 6, 7 and 8 for holding of food products, such as soup, sandwiches and the like. An integrated heating container unit 9 may be releasably located within the uppermost end compartment 8 of the container 1.

The heating unit 9 includes a bowl-shaped container 10 and a conventional cord and plug unit 11 connected within the bottom wall to a known spiral heater 12. The heating unit 9 permits the heating of the food within the container 10. A cover 13 is provided on the cup-shaped container to confine the food product during transport and, if desired, during the heating of food within the container 10.

An inverted U-shaped handle 2 has side arms 14 which extend over the sidewalls of the container and are pivotally interconnected to the container as by pivot pins 14*a*a. A stabilizing bracket (not shown) may be provided on container 2 to prevent swinging about the pivot pins 14*a*.

Referring particularly to FIG. 3, the housing 1 generally includes a generally tubular member having an open top 15 and an open side or front wall 16.

The top door or cover 3 is an L-shaped member having a top portion 17 corresponding to the top 15 of the housing 1. The back edge of the top portion 17 is hinged to the upper edge of the housing 1 by a suitable hinge pin 18. The top portion 17 is shown as a generally channel-shaped portion with the lower edge mating and resting on the top edge 15 of the housing 1 in the closed position. In the closed position, the L-shaped cover 3 defines a depending front wall 20 which extends downwardly over the front edge opening 16 of the housing 1. The depending front wall 20 is illustrated as a generally plate-like member which extends downwardly beneath from the top wall portion 17 and abutts the front edge 16 of the housing 1.

The upper front portion of the housing 1 is extended outwardly in the area of the depending front wall 20 to define a lower recessed portion within which the front door 4 is located. As most clearly shown in FIGS. 2 and 4, the front door 4 is also a generally channel-shaped member having a bottom wall 21 and sidewalls 22 interconnected to a front wall 23. The front cover 4 is hinged to the one side of the housing 1 within the recessed portion as by a hinge pin 24 and in the closed position abutts and front edge of the recessed portion along the sides and bottom. The front cover 4 is provided with a conventional snap-type latch unit 25 connected to the free sidewall and the adjacent sidewall of the housing 1. When the latch unit 25 is closed, the front cover 4 is held securely in the closed position. The top edge of the front door 4 abutts the bottom edge of the depending front wall 20 of the top cover 3 and the underedge of the projecting front edge portions 16. Thus, with the doors 3 and 4 closed, a complete enclosure of the housing results.

In the illustrated embodiment of the invention, the edge of the depending front wall 20 and the top edge of the front door 4 are provided with overlapping portions as shown most clearly at 28 in FIG. 5. A conventional releasable latch unit 29 is secured to the depending wall 20 and to the top portion of the front cover 4 for locking of the top cover 3 in the closed position.

As most clearly shown in FIGS. 2 and 4, the front cover 4 is formed with a partial wall 30 spanning the two sidewalls and secured to the outer edges thereof to define a pocket or chamber within the front door. The wall 30 only extends upwardly through approximately one third the depth of the door 3 to provide ready access thereto for the insertion of implements, such as knife, fork, napkins and the like.

The container 1 is provided with a plurality of shelves 32 and 33 secured in staggered relation for holding of individual food product containers 34 and the like. The lowermost compartment is defined by shelf 32 and the bottom of housing 1 and is shown with a vertical center wall 35 defining a pair of compartments for carrying of beverage or food cans 36 or the like.

The uppermost shelf 33 is located in alignment with the mating edges 28 of the depending front wall 20 and the front cover 4. The top chamber or compartment therefore is essentially totally within the top cover 3 and the cooperating portion of the housing 1. The heating unit 9 is located within such top compartment defined by the shelf 33.

The illustrated heating unit 9 is shown as a bowl-type container 10 having a generally square configuration essentially corresponding to the configuration of the top compartment above the shelf 33. The front-to-back depth of the container 10 is slightly less than that of the housing 1. A T-shaped handle 37 has a stem secured to the front wall of the container 10 with the outer flat plate located to abutt the depending wall 20 in the closed position.

The container 10 is provided with a suitable releasable cap or cover 13 which may have a suitable flanged connection for a sealed attachment to the container. The container 10 may thus be filled with a suitable liquid material, such as soup or the like which is to be heated.

The heating unit further includes the integrated hotplate unit 12 embedded within the bottom wall of the container 10. The electrical cord 11 is secured to the embedded heating unit and extends outwardly through the front wall of the container immediately beneath the T-shaped handle 37. The cord 11 may be conveniently stored by winding of the cord about the T-shaped handle 37 as shown in FIGS. 3 and 6; thereby locating of the cord within the free space beneath the top cover 3.

The portion of the housing 1 between the T-shaped shelves 32-35 and the uppermost shelf 33 define an enlarged chamber within which the conventional plastic covered containers 34 may be stored. Such containers 34 are readily available and have been used for storage and carrying of sandwiches and other food products. Generally, the configuration of the containers 34 conform to the inner configuration of the housing 1 with the door 4 closed. The containers 34 are thereby firmly held within the housing 1.

All of the components with the exception of the illustrated hinge pins and latch units are shown formed of a suitable plastic material which can be molded using known or any other suitable techniques. The hinged connections and the latch units may of course also be integrally molded or otherwise constructed within the present invention. The plastic lunch box provides a highly effective design which may be readily made with an esthetically pleasing appearance while maintaining the desired effective support of the food products.

In use, the upper compartment may of course be used for storing the integrated heating unit. At the time of use, the heating unit can be plugged into a suitable outlet, not shown. The unit can be conveniently removed for eating of the heated food, or even for purpose of carrying to a remote electrical outlet. If for any reason the user knows the food products will not be heated, the heating unit can be removed and replaced with a conventional plastic food storage container or the like.

Thus, the lunch box of this invention provides an improved means for supporting the products and a particularly improved closed container for heating of the food products, as the result of the confinement with the controlled release of fluid from within the hot food container section.

Various modes of carrying out the invention are contemplated as being within the scope of the following claims, particularly pointing out and distinctly claiming the subject matter which is required as the invention.

I claim:

1. A lunch bucket adapted to be carried by an individual workman for on-site use thereby comprising an elongated substantially tubular housing having a substantially greater vertical height than the width and than the depth, said housing having a width substantially the same as the depth to define a cross-section substantially corresponding to a lunch-type sandwich, a handle means secured to the upper end of the housing, said housing having an open top and open front, a top cover secured to said housing at said open top and having a depending side wall projecting down over said open front, a front cover secured to said housing at said open front and extended between said depending side wall and the lower end of said housing, said housing including a plurality of shelf-members defining a plurality of vertically spaced compartments including an uppermost compartment accessible through said open top and through said open side within the length of said depending side wall, and an electrical heating unit including an insulating support and adapted to be releasably deposed within said uppermost compartment.

2. The lunch bucket of claim 1 wherein said heating unit includes a food container having a removable top cover, said container having a handle located within said open front, said heating unit including an electrical cord adapted to be stored on said handle within the open front and open top of said housing.

3. The lunch bucket of claim 1 wherein said members include a T-shaped bottom divider shelf defining a pair of side-by-side compartments adapted to store cans and bottles.

4. The lunch bucket of claim 1 wherein said depending wall and said front cover have overlapping portions, and latch means for releasably interconnecting said depending wall and said front cover.

5. The lunch bucket of claim 2 wherein said members include a lower T-shaped member defining a pair of side-by-side compartments, a second shelf member located substantially in alignment with the mating edges of said front cover and said depending wall of said top cover, said heating unit including a bowl-type container releasably supported on said second shelf member, said container having an integral hot plate in its bottom wall portion and an electrical cord connected thereto, and means on said container to store said cord with said doors closed.

6. The lunch bucket of claim 1 wherein said front cover is channel-shaped and includes a spanning wall joined to the sidewalls to define a door compartment.

7. The lunch bucket of claim 1 wherein said front door is secured to a vertical side edge of said open front.

* * * * *

UNITED STATES PATENT AND TRADEMARK OFFICE

CERTIFICATE OF CORRECTION

PATENT NO. : 4,420,678

DATED : December 13, 1983

INVENTOR(S) : Frank H. Kalb

It is certified that error appears in the above-identified patent and that said Letters Patent is hereby corrected as shown below:

| | | |
|---|---|---|
| Column 6, | Line 1, | Before "members" insert -- shelf- -- |
| Column 6, | Line 9, | Before "members" insert -- shelf- -- |
| Column 3, | Line 29, | After "abutts" "and" should be ---the--- |
| Column 2, | Line 68, | "14aa" should be ---14a--- |

Signed and Sealed this

*Nineteenth* Day of *June 1984*

[SEAL]

*Attest:*

GERALD J. MOSSINGHOFF

*Attesting Officer*

*Commissioner of Patents and Trademarks*